United States Patent [19]

Brown et al.

[11] Patent Number: 4,736,792

[45] Date of Patent: Apr. 12, 1988

[54] VISCOUS OIL RECOVERY METHOD

[75] Inventors: Alfred Brown; Donald S. Mims; Christopher M. Lonvick, all of Houston, Tex.; Terry L. Frazier, Ventura, Calif.

[73] Assignee: Texaco Inc., White Plains, N.Y.

[21] Appl. No.: 947,932

[22] Filed: Dec. 30, 1986

[51] Int. Cl.[4] ..... E21B 43/24; E21B 47/06

[52] U.S. Cl. ..... 166/252; 166/272; 166/263; 166/303

[58] Field of Search ..... 166/250, 252, 268, 272–274, 166/305.1, 303, 263

[56] References Cited

U.S. PATENT DOCUMENTS

| | | | |
|---|---|---|---|
| 3,240,271 | 3/1966 | Ortloff | 166/263 |
| 3,266,569 | 8/1966 | Sterrett | 166/263 |
| 3,295,601 | 1/1967 | Santourian | 166/263 |
| 3,459,265 | 8/1969 | Buxton et al. | 166/263 |
| 3,653,438 | 4/1972 | Wagner | 166/272 X |
| 3,811,503 | 5/1974 | Burnett et al. | 166/274 X |
| 4,099,568 | 7/1978 | Allen | 166/269 |
| 4,434,852 | 3/1984 | Morel et al. | 166/268 X |
| 4,509,596 | 4/1985 | Emery | 166/263 |
| 4,615,392 | 10/1986 | Harrigal | 166/272 |
| 4,617,993 | 10/1986 | Brown | 166/305.1 X |

*Primary Examiner*—George A. Suchfield

*Attorney, Agent, or Firm*—Jack H. Park; Kenneth R. Priem

[57] ABSTRACT

Our invention concerns a method for treating a well completed in a subterranean petroleum containing formation which will improve the rate at which steam can be injected into the formation for a steam push-pull or steam drive oil recovery method. This preconditioning process is applied to formations exhibiting very limited steam receptivity because the formation contains high oil viscosity and has high oil saturation and is completely liquid filled. The method involves injecting a heated non-condensable and oil soluble gas all in the gaseous phase into the formation at a controlled rate which will avoid permanently fracturing the formation and also avoid the immediate formation of an oil bank due to dissolution of the injected gaseous fluid into the oil. Ideally by controlling the injection rate, carbon dioxide first displaces water from the flow channels and then slowly dissolves in the oil. Steam injection can then be applied to the formation without the previously experienced loss in steam injectivity.

13 Claims, No Drawings

VISCOUS OIL RECOVERY METHOD

CROSS REFERENCE TO RELATED APPLICATION

This Application is related to copending application Ser. No 06/947,933 filed Dec. 30, 1986 for Viscous Oil Recovery.

FIELD OF THE INVENTION

The present invention is concerned with a process for stimulating the production of viscous oil or petroleum from a subterranean reservoir. More particularly, this invention is concerned with a preconditioning treatment to be applied to a viscous oil-containing formation prior to steam injection in order to increase the steam injectivity in formations containing high concentrations of highly viscous oil or petroleum.

BACKGROUND OF THE INVENTION

This invention relates to a method for treating a subterranean oil formation containing very viscous petroleum. It is well known to persons skilled in the art of oil recovery that many subterranean deposits of petroleum cannot be produced by conventional primary means because the viscosity of the petroleum is so high that virtually no petroleum flow can be obtained without applying some treatment to decrease the viscosity of the petroleum prior to production. Steam flooding has been used successfully in many such reservoirs with varying degrees of success. Injection of steam into a formation raises the temperature of the formation petroleum contacted by the steam, thereby reducing its viscosity and increasing its ability to flow when a sufficient pressure differential exists within the formation to move heated petroleum toward a production well where it can be recovered to the surface of the earth.

Steam injection has been utilized for recovering viscous petroleum from subterranean deposits in a number of different processes. In one type of steam stimulation, steam is injected into a well, the well is shut in for a period of time, and then production is taken from the same well as was used for steam injection. This method is commonly referred to as cyclic steam injection or huff-puff steam stimulation. In another general class of steam-stimulated viscous oil recovery methods, steam is injected into a formation via one or more injection wells to displace petroleum through the formation toward a remotely-located well where it is recovered from the formation and produced to the surface of the earth. This second type of steam stimulation is referred to as steam drive.

Both of the above-described steam stimulation techniques require that the formation's steam injectivity be sufficiently high to permit injection of a minimum quantity of steam into the petroleum formation in order to raise the temperature of the petroleum, thereby reducing its viscosity sufficiently that it will move through the formation under the pressure differential imposed by the steam injection. When steam is injected into a subterranean reservoir containing viscous petroleum, the petroleum viscosity is decreased to a point where it will begin to migrate and thereby form a oil bank in the formation. An oil bank is a zone within the formation having a higher oil saturation than the original oil saturation, moving in the general direction of petroleum production well.

Certain formations have been found in which steam stimulation is not effective because the formation has very low steam receptivity. These Formations are characterized by high oil viscosity, high oil saturation and are usually fully liquid filled. Even if some steam can be injected at first, the oil bank formed begins to cool at its leading edge as it migrates away from the injection well, thereby resulting in the formation of a high viscosity oil bank which becomes immobile within the formation a short distance from the injection well. Once this occurs, further steam injection is not possible because the high oil saturation in the oil bank reduces the permeability of that portion of the formation which greatly reduces steam injectivity. Once the cooled oil bank forms, it becomes impossible to decrease the viscosity of the immobilized viscous oil bank by contact with steam because no more steam can be injected into the formation.

The above described problem has been recognized by persons experienced in oil recovery procedures, and numerous techniques have been described for improving injectivity of steam into formations containing relatively high oil saturations of very high viscosity petroleum. One of the classical methods for increasing the ability of a formation to accept injected fluid is fracturing, but it has been determined that in the formations such as those described above, fracturing of a formation prior to injection of steam is not a satisfactory solution. While steam will move into the formation through the fractures, as it warms the high viscosity petroleum in the portions of the formations adjacent to the openings created by the fracture process, the viscosity of the petroleum is reduced sufficiently to allow the petroleum to flow into the fractures where it is displaced away from the injection well by the injected steam. As the fluid moves ahead of the steam, it cools and again becomes immobile, closing off the fracture flow path (so long as the injection pressure is less than the fracture pressure) thereby resulting in the same problem as was obtained prior to the fracturing of the formation.

It has also been disclosed in certain prior references that injection of a non-condensable fluid into the formation prior to or simultaneously with the steam injection will maintain flow channels open sufficiently to permit continuing injection of the steam into the formation for successful steam drive viscous oil recovery. The non-condensable gas does indeed open up certain flow channels which permits deeper penetration of the steam into the formation initially, but the heated oil moves into these flow channels much as was described above for results obtained when the formation is fractured, and the flow channels are soon plugged with the viscous petroleum.

In view of the above discussion, it can be appreciated that there is still a substantial unfulfilled need for a method for treating a subterranean formation having very low steam injectivity because of high content of very viscous petroleum to permit the successful development of a steam drive oil recovery process within the formation which does not result in the formation of a flow-impeding barrier within the formation as the viscous petroleum cools and becomes immobile.

DESCRIPTION OF PRIOR ART

U.S. Pat. No. 4,121,661 issued Oct. 24, 1978 describes a method for recovering petroleum from a viscous formation comprising injecting steam and a non-condensable gas in combination with sequentially applied throttling and blowdown steps.

U.S. Pat. 4,099,568 issued July 11, 1978 describes a steam flooding process for viscous oil formations involving injection of steam and a non-condensable, non-oxidizing gas ahead of or in combination with the steam, in order to reduce the tendency for flow channels to become blocked with viscous petroleum.

U.S. Pat. No. 3,908,762 issued Sept. 30, 1975 described a method for establishing a communication path in a tar sand deposit or other very viscous petroleum containing formation using steam and non-condensable gas in a certain described sequence.

U.S. Pat. No. 4,607,699 issued Aug. 26, 1986 describes a method for conditioning subterranean viscous oil-containing formation by fracturing the drainage area by injecting liquid carbon dioxide at pressures in excess of the fracture pressure of the formation prior to injecting steam.

U.S. Pat. No. 4,617,993 issued Oct. 21, 1986 describes a carbon dioxide stimulation process employing hydrocarbon to kill the well after carbon dioxide injection.

SUMMARY OF THE INVENTION

We have discovered that the problem associated with low steam injectivity in subterranean petroleum-containing formations caused by a high concentration of high viscosity oil may be alleviated by a pretreatment with a totally gaseous phase injection fluid which is soluble in the subterranean petroleum. The fluid choice and injection parameters are critical to the successful application of this process. The preferred fluid for use in this process is carbon dioxide or a mixture of carbon dioxide and low molecular weight hydrocarbon, e.g. $C_1$–$C_4$ hydrocarbons. The injected fluid is heated to a temperature above the temperature at which the material would condense at reservoir conditions, in order to ensure that only gas phase treating fluid is injected into the formation. In a preferred embodiment, carbon dioxide is heated to a temperature above its critical temperature, and so the fluid entering the formation is supercritical carbon dioxide. The injection rate is carefully controlled to maintain it above the injection rate at which carbon dioxide absorption in the viscous petroleum would cause the formation of a bank of petroleum mobilized by the absorption of carbon dioxide, and yet safely below the fracture pressure which would cause fracturing of the formation. By maintaining the injection rate in the desired range, it is possible to inject a predetermined quantity of carbon dioxide into the formation such that substantially all of the carbon dioxide initially will pass through the water saturated flow channels of the formation, without any significant portion being absorbed initially by the petroleum, thereby achieving substantial penetration of the formation with the injected gaseous carbon dioxide before significant absorption by the formation petroleum occurs, and yet avoiding fracturing the formation. After the carbon dioxide has been forced into the water saturated flow channels of the formation, the well is shut in for a sufficient period of time to permit absorption of gaseous carbon dioxide form these flow channels previously occupied by water, into the viscous petroleum. Steam may thereafter be injected into the formation via the injection well at a rate substantially greater than the rate originally possible prior to the pretreatment process. The viscosity of the oil for a substantial distance away from the injection well will have been decreased as a result of carbon dioxide absorption, which avoids the rapid formation of an immobile zone of viscous petroleum which would make it impossible to continue injection of steam into the formation. As the petroleum is heated by contacting with steam, carbon dioxide evolves from the heated petroleum. The evolved carbon dioxide then moves ahead of the steam heated oil bank and is absorbed by previously untreated petroleum within the formation as the steam bank moves through the formation toward the production well.

DESCRIPTION OF THE PREFERRED EMBODIMENTS

Our invention is concerned with a preconditioning process for treating a subterranean formation adjacent an injecting well which is to be used for steam injection for the purpose of stimulating the production of viscous petroleum contained in the subterranean formation with which the well is in communication. Although carbon dioxide is an effective oil recovery method in its own right, it is useful mainly in applications where the subterranean formation contains oil of lower viscosity than is contemplated in the present application. The procedure that constitutes the present invention is designed to improve the receptivity of the formation to steam, and is particularly aimed at treating formations where steam injectivity is low initially and/or drops quickly to a very low value soon after initiating steam injection because of the formation of an immobile oil bank within the formation. This is ordinarily experienced in formations which have very viscous petroleum, e.g., petroleum whose viscosity is in excess of 200,000 centipoise at formation temperature, and relatively high oil saturations, e.g,. oil saturations of 60% or greater, and low or essentially zero initial gas saturation. These three factors, the high viscosity oil, the high oil saturation, and the low gas saturation are the common features of formations which exhibit low injectivity or low receptivity to steam, and therefore make steam stimulation of such formations impossible.

There are three essential parameters to be controlled in order to achieve the results described herein by application of our process. (1) The fluid injected into the formation must be substantially all in the gaseous phase at the injection pressure, in order to ensure that it does not itself cause plugging of the limited flow channels existing in the formation at the time the stimulation procedures are applied thereto. (2) The gaseous fluid injected into the formation must be soluble in the petroleum present in the formation. Inert gas such as nitrogen cannot be used successfully in our process. (3) The maximum benefit of our process will be achieved if the oil-soluble gaseous material is injected into the formation at a rate within a narrow range which ensures that the injected fluid displaces water from flow channels of the formation, thereby achieving fairly deep penetration of the formation through these previously water-saturated flow channels before significant amounts of absorption of the injected gaseous fluid by the formation petroleum occurs.

Because of the above-described requirement that the injected gaseous fluid displace water and achieve significant invasion of petroleum formation prior to the oil absorbing the injected fluid, the injection rate is very critical. If carbon dioxide is injected into a formation such as that described herein at a relatively low rate, absorption of carbon dioxide by the formation petroleum near the well will begin immediately, resulting in swelling of the formation petroleum and also in reducing the viscosity of the formation petroleum. This will lead to the formation of a mobile bank of petroleum containing the absorbed carbon dioxide, but the viscosity reduction is not sufficient to permit continued movement of this bank through the formation. At the interface of the undisturbed portion of the formation and the bank of petroleum having carbon dioxide dissolved therein, there will be a transition zone of decreasing carbon dioxide content moving in the direction from the injection well toward the unaffected portion of the formation, with a result that an immobile bank of petroleum will form which cannot subsequently be mobilized by injection of additional carbon dioxide or by injection of steam.

The fluid to be injected into the formation should be one which is entirely in the gaseous phase at the time it enters the formation and which will not condense at formation conditions. If carbon dioxide is used, it is generally necessary to heat the injected fluid in order to ensure that it is above the point where it might condense at injection pressures in the flow channels of the formation adjacent to the injection well. Liquification of the injected fluid will greatly reduce the mobility thereof in a formation which already has low permeability to fluid movement, and will probably result in the formation of the immobile petroleum bank in the formation which would prevent subsequent injection of any fluid into the formation. If pure carbon dioxide is used, one preferred embodiment involves heating the injected fluid to a point which is from 20° to 212° F. and preferably 20° to 62° F. above the critical temperature of carbon dioxide, which ensures that it will remain essentially all in the gaseous phase while it remains in the previously water-saturated flow channels of the formation. A mixture of carbon dioxide with low molecular weight hydrocarbons may also be used, subject to the above described limitations that the gaseous mixture be soluble in the oil and that it not be condensable under formation conditions. A mixture of carbon dioxide and hydrocarbon gases is a desirable embodiment because the solubility of the mixture in oil usually exceeds the solubility of pure carbon dioxide in oil. Also where there is an available supply of low molecular weight hydrocarbon gases, the cost of the injected treated fluid is sometimes reduced by comingling hydrocarbon gas with carbon dioxide.

The quantity of carbon dioxide or other petroleum soluble gaseous treating fluid injected into the formation should be sufficient to substantially fill all of the water filled pore space of the formation in a volume around the wellbore having a radius in the range of from 5 to 30 feet. Sometimes it is impossible to inject the desired volume of carbon dioxide because gas begins migrating from the previously water saturated flow channels of the formation into the oil saturated zone in the portion of the treated zone immediately adjacent to the injection well immediately after the first portion of the gaseous treating fluid is injected, and so the dissolution of injected gaseous material into the petroleum occurs simultaneously with the passage of gas through the flow channels into the formation. As the petroleum absorbs the carbon dioxide or other gaseous treating fluid, the petroleum swells and also experiences reduction in viscosity, and the reduced viscosity of petroleum causes it to migrate into the flow channels which blocks further injection of gas into the formation. If the quantity of gaseous treating fluid determined to be necessary to saturate the water saturated flow channels of the formation for the desired distance away from the injection well cannot be injected in a single step, then an alternative procedure involving backflow of the petroleum into the formation followed by a second gas injection phase must be employed. All of the predetermined quantity of carbon dioxide should be injected into the formation before any steam injection is attempted in order to avoid the subsequent formation of the immobile petroleum zone which blocks the further injection of fluid into the formation.

The rate in which carbon dioxide or the mixture of carbon dioxide and hydrocarbons are injected into the formation is very critical if the desired results described herein are to be achieved. In order to avoid fracturing a portion of the formation adjacent to the well, the injection pressure should be maintained safely below the fracture pressure of the formation. The fracture pressure of the formation is usually known or it can be determined, and for the purpose of our process it is desired to maintain the injection pressure at a value below the actual fracture pressure of the formation. The objective is to displace water away from the formation at the highest rate possible, which means that the pressure should not be allowed to drop significantly below the target injection pressure. The objective of this process is to displace water away from the injection well for a substantial distance, and then have the injected carbon dioxide migrate into the petroleum-saturated portions of the formation adjacent to the previously water-saturated flow channels and be absorbed by the petroleum. If carbon dioxide is injected very slowly into the formation, a substantial portion of the injected carbon dioxide will be absorbed by the formation petroleum in the portions of the formation very close to the injection point, which will cause an immediate drop in the injectivity of the treating fluid into the formation because the previously water saturated flow channels of the formation have become filled with viscous petroleum.

The injection rate is interrelated with the formation porosity and permeability and the pressure in which the fluid is injected into the formation. In one preferred embodiment, the carbon dioxide or mixture of carbon dioxide and hydrocarbons are injected at whatever rate can be achieved while maintaining the injection pressure at a value equal to from 10 to 95 and preferably 50 to 90% of the predetermined fracture pressure of the formation. In most formations of the type to which this process will be applied, this will result to an injection rate which is equal to from 1.25 to 20 and preferably 5 to 10 thousand standard cubic feet (MSCF) of injected gas per foot of formation thickness per day. Accordingly, another preferred method of operating according to the process of our invention is to inject at a pressure safely below the fracture pressure while maintaining the injection rate in the above-described range of standard cubic feet of gas per foot of formation thickness per day.

The volume of carbon dioxide or other treating fluid injected into the formation should be sufficient to essentially fill all of the water-saturated pore space of the formation out to a radius of from 5 to 30 feet. Generally, this will require a volume of $CO_2$ in the range of from 5,000 to 30,000 standard cubic feet of carbon dioxide per foot of formation thickness, with the preferred range being from 10,000 to 20,000 standard cubic feet of gas per foot of formation thickness.

When all of the predetermined desired volume of carbon dioxide has been injected into the formation, some procedure must be utilized to avoid immediate backflow of carbon dioxide into the well. In order to kill the well, e.g., prevent backflow of injected carbon dioxide from the formation into the well, the well should be substantially filled with a liquid which will provide sufficient hydrostatic pressure to ensure that the carbon dioxide does not flow back into the well during the brief soak period prior to steam injection. Cold water should not be used for this procedure, since it will cause the opposite effect from that desired subsequently when steam injection is attempted into the well. In a particularly preferred embodiment, the wellbore is filled with a low viscosity liquid hydrocarbon diluent such as a light crude oil, diesel oil or some other hydrocarbon solvent. This serves the dual function of maintaining the desired hydrostatic pressure on the wellbore which prevents backflow of carbon dioxide, and also helps prevent the formation of blockage along the well face caused by deposition of high molecular weight components of the formation petroleum.

The soak time, e.g., the period of time which the fluid should be left in the formation prior to either backflowing into the well if that is desired or the initiation of steam injection, is in the range of from two hours to 30 days, and preferably 2 to 20 days. Preferably the fluid should be allowed to remain in the formation while monitoring the pressure on the well, with the soak time being terminated when the pressure has stabilized at a constant value. For example, in one field test, the process of our invention was applied to a formation having an initial reservoir pressure of 350 pounds per square inch. Carbon dioxide was injected at a pressure of 900 pounds per square inch and that injection pressure was maintained until all of the predetermined desired volume of carbon dioxide was injected. This was allowed to soak in the formation 19 days until the pressure stabilized at a value of about 650 pounds per square inch. This is a typical pattern, with the stable pressure after soak period being ordinarily several hundred pounds per square inch above the reservoir pressure prior to the injection of carbon dioxide into the formation. Accordingly, one preferred method of operating according to the process of our invention involves injecting the predetermined desired volume of carbon dioxide, and allowing it to remain in the formation until the formation pressure adjacent the injection well has dropped to a value which is from 100 to 400 and preferably from 200 to 300 pounds above the formation pressure prior to injection of carbon dioxide.

If all of the desired volume of carbon dioxide is injected into the formation in the first injection phase, then the next step after the conclusion of the soak phase will be to initiate injecting steam into the formation, and no further treatment should be necessary to maintain steam injectivity. As steam enters the formation, it contacts petroleum adjacent to the wellbore, which causes several separate effects on the petroleum. Increasing the temperature causes carbon dioxide to evolve from the petroleum, which causes the viscosity of petroleum to increase. The carbon dioxide which has broken out of solution moves away from the formation near the injection well because of the pressure differential during the steam injection phase, and the carbon dioxide is absorbed by petroleum in portions of the formation not previously contacted by carbon dioxide during the first injection phase. Evolution of carbon dioxide from petroleum leaves some gas saturation in the petroleum adjacent to the injection well which improves steam injectivity somewhat.

Another effect caused by contact between steam and petroleum is the viscosity reduction inherent in increasing the temperature of the petroleum, which more than offsets the adverse effect of causing carbon dioxide to be released from the petroleum. Heated petroleum then moves in the same direction as the steam is moving, and causes the creation of a bank of heated petroleum within the formation. In this instance, the heated oil bank does not become immobile as occurs when steam is injected without the previous treatment according to our process because carbon dioxide is moving ahead of the petroleum bank, maintaining injectivity by occupying some of the flow channels in the formation thereby keeping them open and also preconditioning the oil ahead of the heated oil bank by dissolution of carbon dioxide into the oil which causes a reduction in the viscosity of the oil ahead of the heated oil bank.

In some formations, it is not possible to inject the predetermined desired volume of carbon dioxide during the first injection phase because of very high oil saturation in the formation. When this occurs, it may be necessary to backflow oil and carbon dioxide into the well after the first carbon dioxide injection phase and produce this backflowed oil to the surface of the earth, after which a second carbon dioxide injection phase is initiated. When the total amount of carbon dioxide injected into the formation is equal to the predetermined desired volume, steam injection may be initiated.

One method of determining when it is desired to backflow carbon dioxide and oil and conduct a second carbon dioxide injection phase prior to injection of steam may be identified by monitoring the pressure in the formation. After injecting carbon dioxide until the pressure approaches the fracture pressure of the formation, the well should be shut in and the pressure monitored during the soak phase. If the pressure drops significantly, e.g., if it drops to a value which is from 30 to 80% below the pressure obtained during the injection phase, then sufficient pretreatment has been accomplished so steam injection may be initiated immediately without backflowing the wall or conducting a second carbon dioxide injection phase. If however, the pressure does not drop in the formation after the initial amount of carbon dioxide has been injected by at least 20% of the maximum pressure obtained during the injection phase, then the well should be produced in order to reduce the oil saturation in the immediate vicinity of the well and a second carbon dioxide injection phase should be applied before steam injection is attempted.

FIELD EXAMPLES

Numerous field experiments were conducted to test the validity of the procedures described herein for increasing steam injectivity in a field where a combination of high oil viscosity and high oil saturation prevented steam stimulation because it was impossible to inject sufficient steam into the formation to reach the desired temperature where the formation oil became mobile.

One formation in which steam stimulation was desired was at a depth of 1,120 feet, and the oil saturation about 65%. The viscosity of the oil was in the range of about 362,500 centipoise. Several attempts were made to inject low quality steam (44%) at an initial rate of 788 BSPD (cold water equivalent) and pressures of 850 pounds per square inch in one instance and from 1300 to 1400 pounds per square inch in another. After a brief period of time (1 to 2 days) the injection rate dropped to zero. No steam could be injected into the well thereafter, indicating that the steam injectivity had been reduced essentially to zero as a results of the mobilization of viscous petroleum which cooled and became immobile, forming a block a short distance in the formation from the injection well.

It was decided to inject carbon dioxide into the formation for the purpose of preconditioning the formation, thereby increasing the injectivity to subsequent steam injection in accordance with the teachings of the present invention. The desired volume of $CO_2$ was determined using a recognized technique, the Marx Langenheim method, with a desired steam zone radii for three candidate wells ranging from 20.9 to 29.03 feet. The volumes of $CO_2$ required to saturate the water-saturated flow channels for these radii range from 3.42 to 9.40 MMSCF (9,400,000 standard cubic feet) which should saturate the oil with about 0.6 to 0.7 mole fractions of $CO_2$ in the effective radius. Because of the effect of fingering and channeling, not all of the oil inside this radius will be saturated with $CO_2$, but a substantial amount will be. Also, some of the carbon dioxide will remain in the flow paths previously occupied by water, thus opening gaseous flow paths for subsequently injected steam. The oil nearest the wellbore would be fully saturated with carbon dioxide due to the large number of $CO_2$ pore volumes contacting this portion of the reservoir.

Two criteria were maintained during the carbon dioxide phase. (1) The carbon dioxide pressure was not allowed to exceed the fracture pressure formation (1,500 psi for one well and approximately 1,000 psi for another well). Although design conditions are based on calculated fracture pressure for the formation, the actual fracture pressure may be different. The actual occurrence of a fracture is detected during injection of $CO_2$ by a sudden, significant drop in pressure. If this occurs, the injection pressure should be reduced, which will ordinarily allow the formation to heal (the fractures close) and the process can thereafter be continued. Secondly, the actual injection rate should not deviate from a proposed injection rate designed on the basis of maintaining carbon dioxide injection under conditions which cause displacement of water from the flow channels of the formation while avoiding either fracturing the formation or the creation of an oil bank due to absorption of excessive amounts of $CO_2$ by the formation oil. Injection rates for carbon dioxide were maintained at the rate of about 3.0 to about 4.0 standard cubic feet of gas per foot of formation per day during this period. After a soak period of from 5 to 20 days, steam injection was possible in these wells without loss of steam injectivity as had been experienced prior to the treatment of carbon dioxide.

An essentially identical experiment was conducted to determine whether the injection of nitrogen under conditions such as those described above in such a formation would produce similar results. Nitrogen was injected into the formation, and allowed to soak for a period of time. The pressure response observed during and subsequent to the nitrogen injection was similar to that experienced with carbon dioxide, except when steam injection was attempted, the steam injectivity behaved about the same as had been experienced in this formation when there had been no preconditioning treatment at all. In other words, it was observed that injection of nitrogen, a non-condensable gas which is essentially insoluble in the formation petroleum under the conditions existing in the reservoir did not cause the improved steam receptivity that was accomplished when a gas which is soluble in the formation petroleum is utilized in accordance with our teachings.

PILOT FIELD EXAMPLE

For purpose of additional disclosure including best mode operation, the following constitutes a description of what we consider to be the best mode of operating in accordance with the teachings of our invention.

A subterranean formation containing oil whose viscosity at the formation temperature (83° F.) is 362,500 centipoise and the oil saturation is 65%. Steam injection in this well is impossible because of the formation of an immobile viscous oil barrier after a few days of steam injection, no matter how the steam injection is applied.

It is decided to inject carbon dioxide into the formation in order to saturate the petroleum in the formation and to occupy all of the water filled pore space to a radius of about 20 feet from the injection well. The formation thickness is approximately 190 feet. In order to displace water from the formation and saturate at least a substantial portion of the oil in the treated zone, it is determined that the total amount of carbon dioxide required is 4.98MM standard cubic feet (200 tons).

The temperature of the petroleum formation is 83° F. In order to ensure that the carbon dioxide enters the formation entirely in the gaseous phase and that no condensation occurs within the flow channels after $CO_2$ injection, the carbon dioxide is heated to a temperature of 110° F., which is 22° over the critical temperature of carbon dioxide at 900 psi, which is the design injection pressure for this application. It is desired to inject this total volume of carbon dioxide into the formation over a time period of 166 hours, and so the injection rate is maintained at an average of 30M standard cubic feet per hour.

The pressure in the formation prior to the injection of carbon dioxide was determined to be 350 pounds per square inch and the fracture pressure of the formation was calculated to be 1,000 pounds per square inch, although field experience indicated that the actual fracture pressure was several hundred pounds higher. In order to inject the carbon dioxide at a pressure which is safely below the actual fracture pressure, it is determined that the maximum carbon dioxide injection pressure will be 1,050 psi.

Carbon dioxide is injected into the formation and the injection pressure is monitored. The pressure begins rising after only 1.0 MSCF of carbon dioxide has been injected, indicating that it will not be possible to inject all of the carbon dioxide into the formation during the first $CO_2$ injection cycle. After the injection pressure rises to 1,050 psi, further $CO_2$ injection is not considered to be safe, and so injection is terminated. The well is killed by filling the wellbore with 35° API crude oil, a light oil which will maintain the pressure within the wellbore. Additionally, this light oil is slowly circulated past the perforations by injecting oil down the tubing at a rate of 30 barrels per day in order to ensure that no plugging of the formation face occurs as a result of high molecular weight hydrocarbons such as asphaltenes forming thereon during the soak period. Carbon dioxide is maintained in the formation for a period of approximately 20 days, after which the well is produced and approximately 2,350 barrels of oil are recovered from the formation. This reduces the oil saturation in the portion of the formation immediately adjacent to the injection well, ensuring that when carbon dioxide injection is resumed during the next cycle, greater penetration of the formation will be achieved. Carbon dioxide is then injected into the well for a second cycle until the last of the original desired volume of carbon dioxide has been injected, and the pressure in the formation is monitored. Once the pressure has declined to about 650 psi, it is determined that sufficient carbon dioxide has been absorbed by the petroleum in the formation to allow injection of steam into the well. Next, 44% quality of steam is injected into the well, and it is determined that the formation accepts steam at a rate of about 800 barrels of steam per day at an injection pressure of ~1,000 psi. Steam injection is continued for a long period of time without any loss of injectivity, indicating that the injectivity problem has been cured by the carbon dioxide treatment process.

While our invention has been described in terms of a number of illustrative embodiments, it is clearly not so limited since many variations thereof will be apparent to persons skilled in the related art without departing from the true spirit and scope of our invention. In addition, theories have been advanced to explain the benefits observed when this procedure is applied to the formation, although it is not necessarily implied that these are the only mechanisms responsible for the observed benefits. It is our wish and desire that our invention be limited and restricted only by those limitations and restrictions appearing in the claims appended immediately hereinafter below.

We claim:

1. A method for recovering petroleum from a subterranean, viscous petroleum-containing formation having some water filled channels and very low gas saturation, penetrated by at least one injection well, by steam injection, wherein the improvement for treating the formation to increase the receptivity of the formation to steam comprises:

(a) introducing a predetermined quantity of a treating fluid which is all in the gaseous phase, heated to a temperature above the temperature at which the fluid would condense at reservoir conditions, into the the formation via the injection well, said treating fluid being soluble in the formation petroleum, at a pressure which is equal to from 10% to 90% the fracture pressure of the formation and at a rate which accomplishes displacement of water from the water-saturated flow channels of the formation;

(b) leaving the injected treating fluid in the flow channels of the formation from which water was displaced in step (a) for a period of time sufficient to allow absorption of the treating fluid into the petroleum, which causes reduction in the petroleum viscosity; and (c) thereafter injecting steam into the formation via the injection well; and (d) recovering petroleum from the formation.

2. A method as recited in claim 1 wherein the treating fluid injected into the formation in step (a) comprises carbon dioxide.

3. A method as recited in claim 2 wherein the treating fluid comprises a mixture of carbon dioxide and $C_1$–$C_4$ hydrocarbon gases.

4. A method as recited in claim 2 wherein the treating fluid consist essentially of carbon dioxide.

5. A method as recited in claim 1 wherein the treating fluid is carbon dioxide and the fluid is heated to a temperature of at least 20° above its critical temperature so the fluid enters the formation as a supercritical fluid.

6. A method as recited in claim 1 wherein the amount of treating fluid injected into the formation is from 5,000 to 30,000 standard cubic feet per foot of formation.

7. A method as recited in claim 1 wherein the amount of treating fluid injected into the formation is from 10,000 to 20,000 standard cubic feet per foot of formation.

8. A method as recited in claim 1 comprising the additional step of shutting in the well after injecting the treating fluid and monitoring the pressure at the formation face, and commencing injection of steam after the pressure has dropped to a value equal to from 100 to 400 pounds per square inch below the injection pressure at the end of the injection phase.

9. A method as recited in claim 8 wherein the injected treating fluid is left in the formation for a soak period or from 2 hours to 30 days.

10. A method as recited in claim 8 wherein the injected treating fluid is left in the formation for a soak period or from 2 to 20 days.

11. A method as recited in claim 1 comprising the additional step of introducing a liquid hydrocarbon into the well immediately after the treating fluid has been injected to occupy at least a substantial portion of the wellbore in order to maintain the pressure of the injected treating fluid in the formation.

12. A method for recovering petroleum from a subterranean, viscous petroleum-containing formation having some water filled flow channels and low gas saturation, penetrated by at least one injection well, by steam injection, wherein the improvement for treating the formation to increase the receptivity of the formation to steam comprises:

(a) introducing a predetermined quantity of a treating fluid which is all in the gaseous phase into the formation via the injection well, said treating fluid being heated to a temperature above the temperature at which the fluid would condense at reservoir conditions, said treating fluid being soluble in the formation petroleum, said fluid being injected at a pressure below the fracture pressure of the formation and at a rate of from 1250 to 20,000 standard cubic feet of fluid per foot of formation per day which accomplishes displacement of water from the water saturated flow channels of the formation;

(b) leaving the injected treating fluid in the flow channels of the formation from which water was displaced in step (a) for a period of time sufficient to allow absorption of the fluid into the petroleum, which causes reduction in the petroleum viscosity; and (c) thereafter injecting steam into the formation via the injection well; and (d) recovering petroleum from the formation.

13. A method as recited in claim 12 wherein the treating fluid is injected into the formation at a rate of from 5,000 to 10,000 standard cubic feet of fluid per foot of formation per day.

* * * * *